US008272282B2

(12) United States Patent
Kawasaki et al.

(10) Patent No.: US 8,272,282 B2
(45) Date of Patent: Sep. 25, 2012

(54) STARTER MOTOR HAVING A SHOCK ABSORBER

(75) Inventors: Kenji Kawasaki, Anjo (JP); Kazuhiro Andoh, Okazaki (JP); Shinji Andoh, Nagoya (JP)

(73) Assignee: Denso Corporation, Kariya (JP)

( * ) Notice: Subject to any disclaimer, the term of this patent is extended or adjusted under 35 U.S.C. 154(b) by 545 days.

(21) Appl. No.: 12/314,148

(22) Filed: Dec. 4, 2008

(65) Prior Publication Data

US 2009/0167102 A1 Jul. 2, 2009

(30) Foreign Application Priority Data

Dec. 26, 2007 (JP) ..... 2007-333656

(51) Int. Cl.
*F02N 15/02* (2006.01)

(52) U.S. Cl. ..... 74/7 E

(58) Field of Classification Search ..... 74/6, 7 A, 74/7 C, 7 E, 7 R
See application file for complete search history.

(56) References Cited

U.S. PATENT DOCUMENTS 1,759,076 A * 5/1930 Whitney ..... 74/6
1,855,937 A * 4/1932 Callsen ..... 74/7 R
2,280,432 A * 4/1942 Hodges ..... 74/9
2,571,231 A * 10/1951 Gilbert ..... 74/7 C
2,640,359 A * 6/1953 Gilbert et al. ..... 74/7 C
2,679,170 A * 5/1954 Prittie ..... 475/159
2,863,335 A * 12/1958 Miller ..... 475/265
3,851,532 A * 12/1974 Pfluger et al. ..... 74/7 A
4,635,489 A * 1/1987 Imamura et al. ..... 74/7 E
5,323,663 A * 6/1994 Ohgi et al. ..... 74/7 E
6,782,770 B2 * 8/2004 Saito et al. ..... 74/7 E
7,018,314 B2 * 3/2006 Hasegawa et al. ..... 475/5
7,194,925 B2 * 3/2007 Kajino et al. ..... 74/7 E
7,451,668 B2 * 11/2008 Hasegawa et al. ..... 74/7 E
7,520,190 B2 * 4/2009 Hasegawa et al. ..... 74/7 E
7,677,123 B2 * 3/2010 Nawa ..... 74/7 C (Continued)

FOREIGN PATENT DOCUMENTS

CN 1616816 A 5/2005

(Continued)

OTHER PUBLICATIONS

Chinese Office Action dated Jul. 14, 2010 in corresponding Chinese Patent Application No. 200810186228.9 (with translation).

(Continued)

*Primary Examiner* — Daniel P. Stodola
*Assistant Examiner* — Daniel Wiley
(74) *Attorney, Agent, or Firm* — Oliff & Berridge, PLC

(57) ABSTRACT

In a starter motor equipped with a shock absorbing device, a disk spring is placed between a bottom part of a cylindrical casing and one side of a disk stack structure composed of rotatable disks and fixed disks which are alternately stacked. Caulking parts formed at an opening end of the cylindrical casing are bent toward the inner diameter side of the cylindrical casing in order to push the disk spring toward the bottom part side of the cylindrical casing through the disk stack structure. The disk spring accumulates reaction force (or elastic force) by the caulking. The reaction force accumulated in the disk spring pushes the disk stack structure to the axial direction of the cylindrical casing. The structure of the shock absorbing device can supply a uniform load to the disk spring, and provides a stable shock absorbing capability.

5 Claims, 7 Drawing Sheets

U.S. PATENT DOCUMENTS

| | | | | |
|---|---|---|---|---|
| 2002/0069711 | A1* | 6/2002 | Hosoya | 74/6 |
| 2004/0123686 | A1* | 7/2004 | Kajino et al. | 74/7 E |
| 2004/0180746 | A1* | 9/2004 | Hasegawa et al. | 475/2 |
| 2005/0076727 | A1* | 4/2005 | Hasegawa et al. | 74/7 E |
| 2008/0087134 | A1* | 4/2008 | Nawa | 74/7 E |
| 2008/0196544 | A1* | 8/2008 | Kajino et al. | 74/7 E |
| 2010/0269631 | A1* | 10/2010 | Niimi et al. | 74/7 E |

FOREIGN PATENT DOCUMENTS

| | | |
|---|---|---|
| JP | A-62-247175 | 10/1987 |
| JP | A-2005-113816 | 4/2005 |
| JP | A-2008-116038 | 5/2008 |

OTHER PUBLICATIONS

European Search Report mailed on May 27, 2010 in corresponding European Patent Application No. 08 020 561.0.

Aug. 2, 2011 Office Action issued in Japanese Application No. 2007-333656 (with English Translation).

* cited by examiner

STARTER MOTOR HAVING A SHOCK ABSORBER

CROSS-REFERENCE TO RELATED APPLICATION

This application is related to and claims priority from Japanese Patent Application No. 2007-333656 filed on Dec. 26, 2007, the contents of which are hereby incorporated by reference.

BACKGROUND OF THE INVENTION

1. Field of the Invention

The present invention relates to a starter motor equipped with a shock absorbing device or an excessive torque absorbing device.

2. Description of the Related Art

There is well known a starter motor equipped with a shock absorbing device (or an excessive torque absorbing device). The shock absorbing device is a multiple disk type, which is composed mainly of a plurality of disks which are stacked. For example, Japanese patent laid open publication NO. 2005-113816 has disclosed such a starter motor.

FIG. 7 shows a cross section of a conventional shock absorbing device of a multiple disk type assembled into a conventional starter motor.

As shown in FIG. 7, the shock absorbing device is composed mainly of a cylindrical casing 100 having one bottom part, a plurality of rotatable disks 110, a plurality of fixed disks 120, and a disk spring 130. The rotatable disks 110 are rotatably placed in the inner periphery of the cylindrical casing 100. The fixed disks 120 are fixed in the cylindrical casing 100. The rotatable disks 110 form an internal gear of a speed deceleration device (or a planetary gear speed reduction device). The rotatable disks 110 and the fixed disks 120 are alternately placed along the thickness direction (or along the axial direction) in the cylindrical casing 100.

The rotatable disks 110 in the shock absorbing device rotate against the frictional force which is generated between the rotatable disks 110 and the fixed disks 120. The rotation of the rotatable disks 110 absorbs an excess torque or force applied to the internal gear from outside when an internal combustion engine starts to rotate.

However, the conventional shock absorbing device in the starter motor has the above structure in which the disk spring 130 is placed on the opposite surface of the bottom part of the cylindrical casing 100. That is, as shown in FIG. 7, the disk spring 130 is the upper side of the disk stack structure, which is far apart from the bottom part of the cylindrical casing 100. In other words, the disk stack structure is placed between the bottom part of the cylindrical casing 100 and the disk spring 130. This structure of the conventional shock absorbing device requires to form the inner diameter of the disk spring 130 to being smaller than the diameter of the tooth bottom of the internal gear (as composed of the rotatable disks 110) in order to avoid any interference between the disk spring 130 and a planetary gear which is mated with the internal gear. This structure reduces the width of the disk spring 130. In other words, because this structure decreases the ratio (outer diameter/inner diameter) of the outer diameter and the inner diameter of the disk spring 130, the force generated by the deflection of the disk spring 130 increases, and as a result, the durability of the disk spring 130 decreases.

When the end part at the opening side of the cylindrical casing 100 is caulked toward its inside direction in order to bend the disk spring 130, the sloped part (as the sloped surface) of the disk spring 130 is forcedly pushed to the end part at the opening side of the cylindrical casing 100. This introduces a possibility of inclining the disk spring 130 when the cylindrical casing 100 is caulked. On caulking, because the load applied to the disk spring 130 becomes unstable, the shock absorbing capability of the shock absorbing device becomes varied. Furthermore, caulking the end part at the opening side of the cylindrical casing 100 toward its inside direction to bend the disk spring 130 requires to fix both the disk spring 130 and the cylindrical casing 100. Thus, there is much left to improve the caulking process in the starter motor assembling work.

SUMMARY OF THE INVENTION

It is an object of the present invention to provide a starter motor equipped with a shock absorbing device that has an improved structure capable of reducing an excess stress applied to a disk spring in order to increase the lifetime of this disk spring and to keep a stable shock absorbing capability. In addition, another object of the present invention is to provide the starter motor having the improved structure capable of providing easy working process of bending the disk spring during caulking.

To achieve the above purposes, the present invention provides a starter motor having an electric motor, a planetary gear speed reduction device, and a shock absorbing device. The electric motor generates a rotational power. The planetary gear speed reduction device reduces a rotation speed of the electric motor and outputs the reduced rotation speed. The shock absorbing device limits a rotation of an internal gear in the planetary gear speed reduction device by a friction force. The shock absorbing device absorbs a shock applied from an internal combustion engine by rotating the internal gear against the friction when the shock of a load torque over a predetermined level is applied to the internal gear. In particular, the shock absorbing device has a cylindrical casing, a plurality of rotatable disks, a plurality of fixed disks, a disk spring, and pushing means. The cylindrical casing has one bottom part. The rotatable disks form the internal gear. The fixed disks are fixedly placed in the inner periphery of the cylindrical casing so that each rotatable disk is sandwiched between a pair of the fixed disks. The disk spring is placed between the bottom part of the cylindrical casing and a disk stack structure. The disk stack structure is composed of the rotatable disks and the fixed disks which are stacked alternately along the axial direction of the cylindrical casing. The pushing means pushes the disk spring toward the bottom part side of the cylindrical casing through the disk stack structure in order to generate an elastic force of the disk spring.

According to the structure of the present invention, in particular, because the disk spring is placed between the bottom part of the cylindrical casing and the disk stack structure, the pushing means can supply a uniform load to the disk spring. As a result, the shock absorbing device has a stable shock absorbing capability.

Still further, placing the disk spring between the bottom part of the cylindrical casing and the disk stack structure can prevent the disk spring to be inclined when the pushing means pushes the disk spring. Because the pushing means is placed in the cylindrical casing without pushing the disk spring, this structure of the shock absorbing device can improve the efficiency of assembling the disk stack structure and the disk spring into the cylindrical casing using the pushing means.

BRIEF DESCRIPTION OF THE DRAWINGS

A preferred, non-limiting embodiment of the present invention will be described by way of example with reference to the accompanying drawings, in which.

DETAILED DESCRIPTION OF THE PREFERRED EMBODIMENTS

Figure 1B:
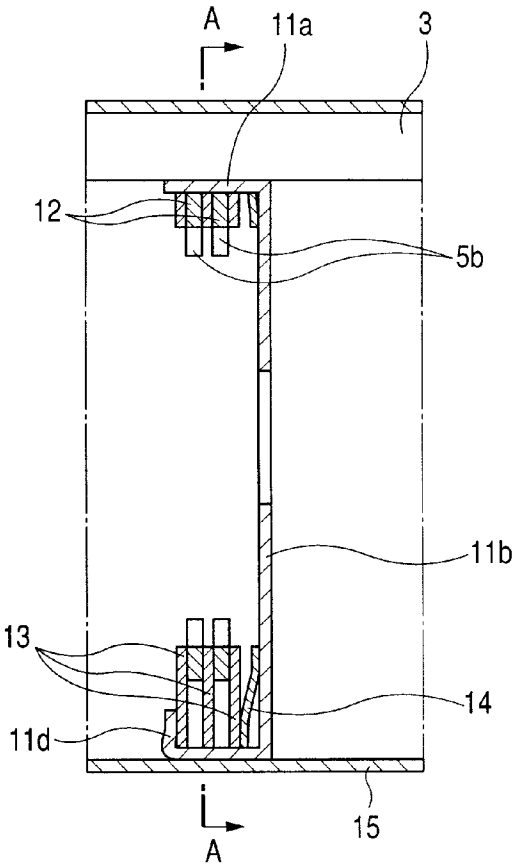
FIG. 1B is a cross section of the shock absorbing device along the B-O-B line shown in FIG. 1A.

Hereinafter, various embodiments of the present invention will be described with reference to the accompanying drawings. In the following description of the various embodiments, like reference characters or numerals designate like or equivalent component parts throughout the several diagrams.

First Embodiment

A description will be given of the starter motor 1 equipped with a shock absorbing device 10 according to the first embodiment of the present invention with reference to FIG. 1A, FIG. 1B, to FIG. 4.

Figure 1A:
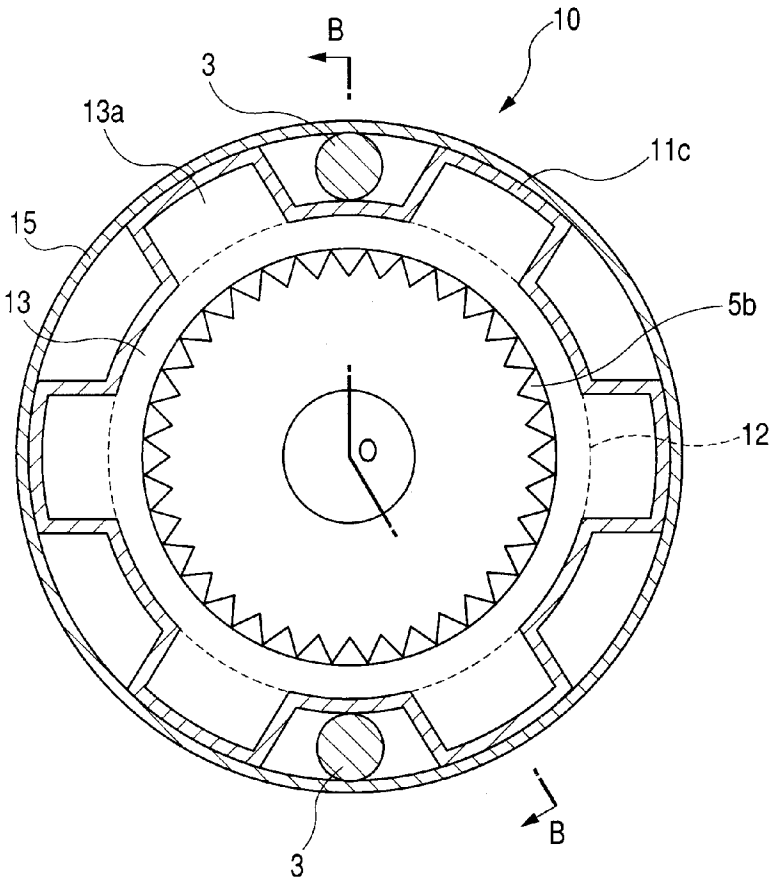
FIG. 1A is a cross section of a shock absorbing device, along the A-A line shown in FIG. 1B, in a starter motor according to the first embodiment of the present invention.
Figure 2:
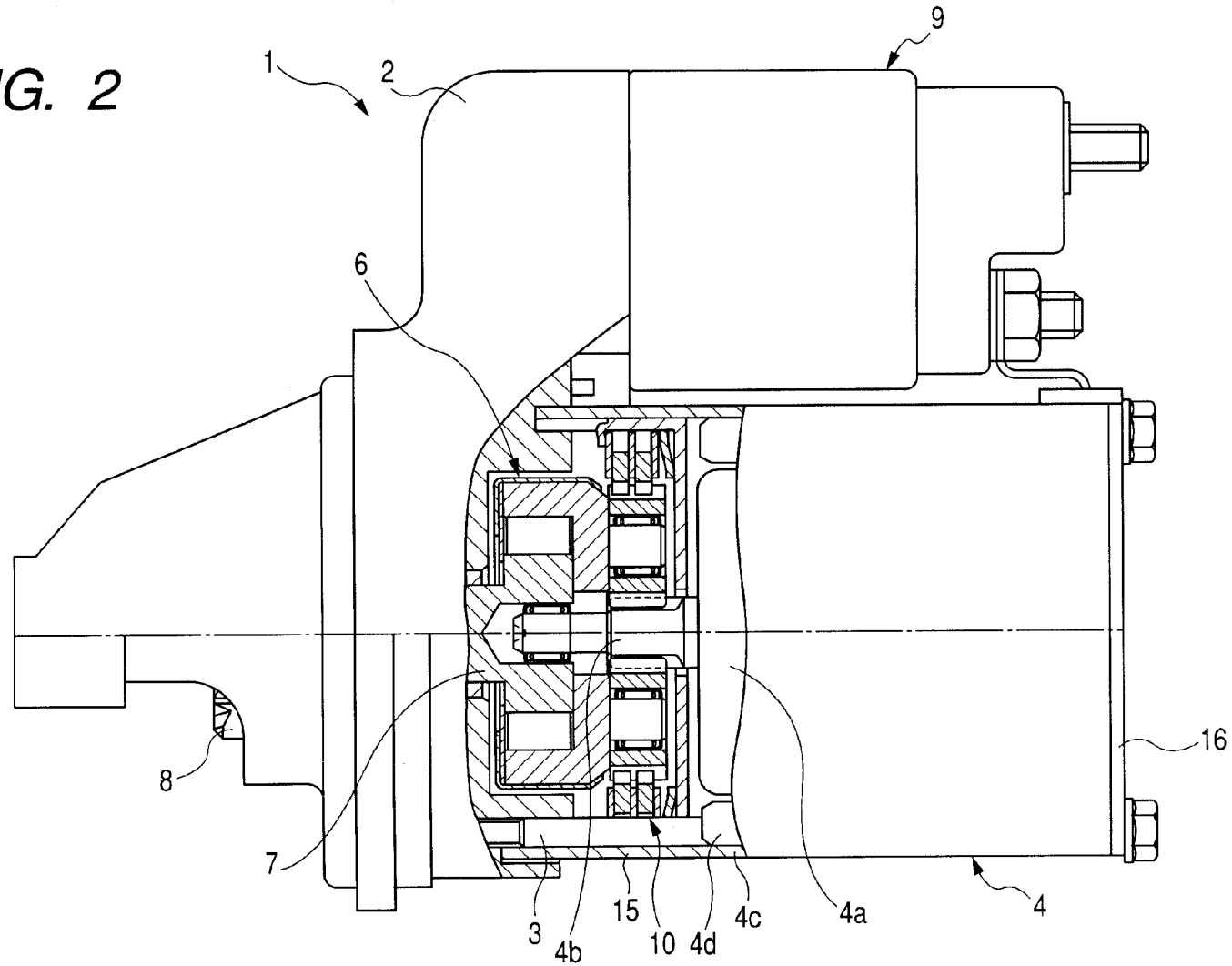
FIG. 2 is a schematically entire view of the starter motor equipped with the shock absorbing device, shown in FIG. 1A and FIG. 1B, according to the first embodiment of the present invention.
Figure 3:
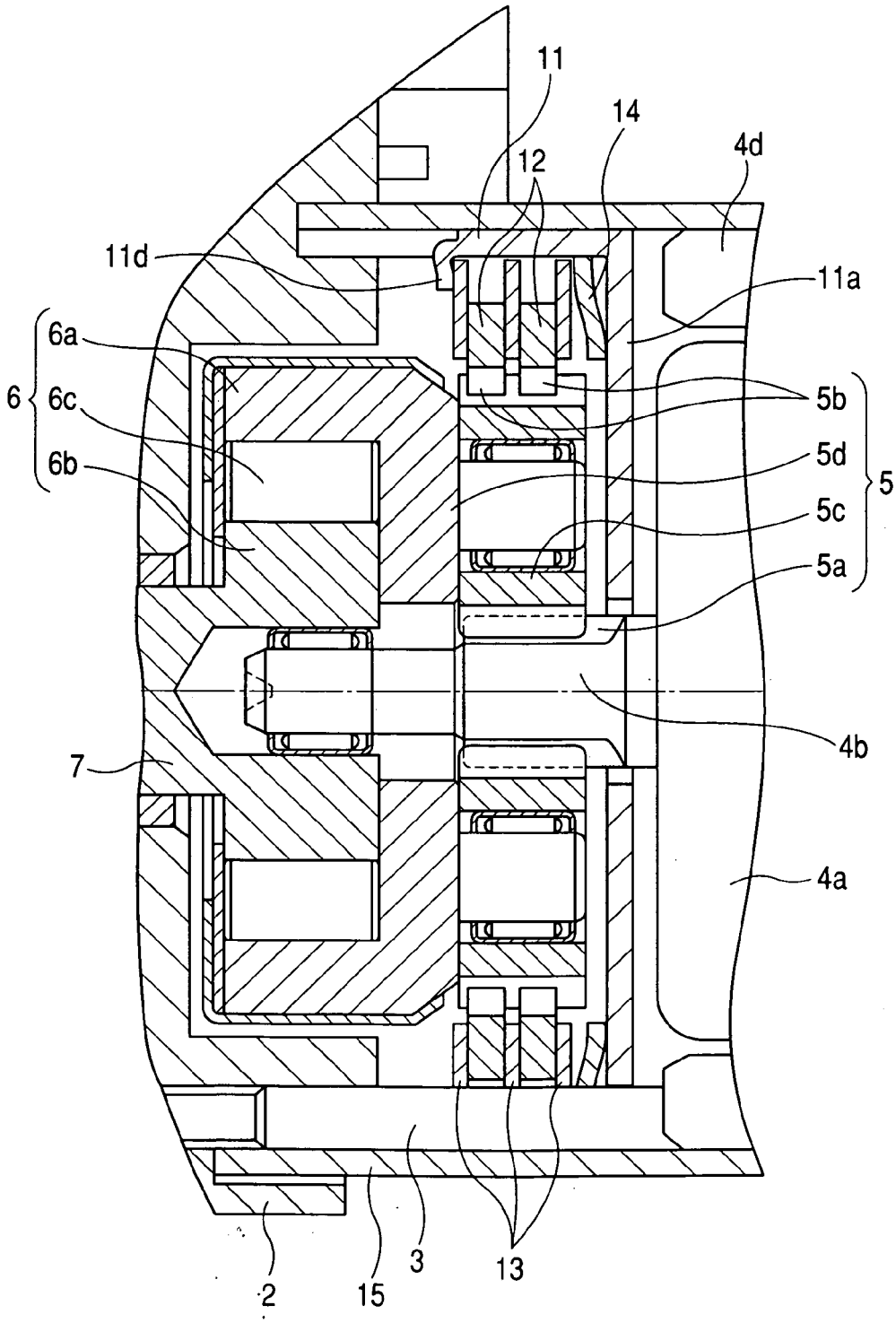
FIG. 3 is an enlarged cross section of the shock absorbing device according to the first embodiment of the present invention shown in FIG. 1A and FIG. 1B.

FIG. 1A is a cross section of the shock absorbing device 10, along the A-A line shown in FIG. 1B, in the starter motor 1 according to the first embodiment of the present invention. FIG. 1B is a cross section of the shock absorbing device 10 along the B-O-B line shown in FIG. 1A. FIG. 2 is a schematically entire view of the starter motor 1 according to the first embodiment of the present invention equipped with the shock absorbing device 10. FIG. 3 is an enlarged cross section of the shock absorbing device 10 according to the first embodiment of the present invention shown in FIG. 1A and FIG. 1B.

The starter motor 1 according to the first embodiment is comprised mainly of a housing 2 tightly mounted to an internal combustion engine (not shown), an electric motor fixed to the housing 2 by several through bolts 3, a planetary gear speed reduction device 5 (or a reduction device for short or a reduction gear, see FIG. 3) capable of reducing the rotation speed of the electric motor 4, an output shaft 7 engaged with the reduction device 5 through a one-way clutch 6, a pinion gear 8 supported on the output shaft 7, a magnetic switch 9, and the shock absorbing device 10. The magnetic switch 9 controls a shift lever (not shown) to move toward the axial direction of the starter motor 1.

In the starter motor 4 according to the first embodiment, a commutator is placed at one end side (at the opposite side of the reduction device 5) of an armature shaft 4*b*. The starter motor 4 is a well-known rectifier type electric motor in which a current is supplied to the armature 4*a* through a brush (not shown). This brush slides on the outer periphery of the commutator.

The reduction device 5 (or the reduction gear) is a planetary gear type reduction device. The reduction device 5 and the armature shaft 4*b* are assembled onto a same shaft. As shown in FIG. 3, the reduction device 5 is composed mainly of a sun gear 5*a*, an internal gear 5*b*, a plurality of planetary gears 5*c*, and a planetary carrier 5*d*. The sun gear 5*a* is fixed to the armature shaft 4*b*. The internal gear 5*b* is a ring shape, which is composed of rotatable disks 12 (these will be explained later). The sun gear 5*a* and the internal gear 5*b* are placed in a concentric configuration. The planetary gears 5*c* are engaged with the sun gear 5*a* and the internal gear 5*b*. The planetary carrier 5*d* outputs the force caused by the revolution of the planetary gears 5*c*.

As shown in FIG. 3, the one-way clutch 6 is composed mainly of an outer 6*a*, an inner 6*b*, and a roller 6*c*. The outer 6*a* and the planetary carrier 5*d* are assembled together. The inner 6*b* and the output shaft 7 are assembled together. The roller 6*c* permits and interrupts the transmission of the torque between the outer 6*a* and the inner 6*b*.

On starting the operation of the internal combustion engine, the driving torque of the motor 4 which is increased by the reduction device 5 is transmitted to the output shaft 7 through the one-way clutch 6.

When the pinion gear 8 is driven by the internal combustion engine after the internal combustion engine correctly starts, the one-way clutch 6 interrupts the connection between the inner 6*b* and the outer 6*a* in order to interrupt the transmission of the output torque. This one-way clutch 6 is a roller type.

The output shaft 7 and the armature shaft 4*b* are placed on the same axial line, so that the driving torque as the output torque of the electric motor 4 is transmitted to the output shaft 7 through the clutch 6. The output shaft 7 thereby rotates.

The pinion gear 8 is placed in a helical spline engagement on the outer periphery of the output shaft 7. When the internal combustion engine starts, the pinion gear 8 is engaged with the ring gear (not shown) of the internal combustion engine in order to transmit the driving torque of the electric motor 4 to the ring gear.

The magnetic switch 9 has a magnetic coil (not shown) to form an electrical magnet. When the magnetic switch 9 is turned on, the magnetic switch 9 attracts a plunger (not shown) in order to close a main contact. When the magnetic switch 9 is turned off, and the magnetic switch 9 does not attract the plunger, a retraction spring (not shown) retracts the plunger 9. The main contact is thereby open.

As shown in FIG. 1B, the shock absorbing device 10 is comprised mainly of a cylindrical casing 11, a disk stack structure, and a disk spring 14.

The cylindrical casing 11 has a cylindrical body part 11*a* and a ring-shaped bottom part 11*b*. The disk stack structure is composed mainly of a plurality of the rotatable disks 12 (two disks in the first embodiment), and a plurality of fixed disks 13 (three fixed disks in the first embodiment). The rotatable disks 12 and the fixed disks 13 are alternately stacked and placed in the inside of the cylindrical casing 11. The disk spring 14 pushes the disk stack structure toward the axial direction of the cylindrical casing 11.

As shown in FIG. 1A, the cylindrical casing 11 has a plurality of convex parts 11*c*. Each convex part 11*c* is a circumferential part of the cylindrical body part 11*a* that projects toward the outside of the diameter direction.

The convex parts 11*c* are formed along the circumferential direction of the cylindrical body part 11*a* at a regular interval.

The cylindrical casing 11 is fixedly placed in the inner periphery of a cylindrical wall 15. That is, the inner peripheral surface of each convex part 11*c* is fitted to the inner circumferential surface of the cylindrical wall 15. This cylindrical wall 15 is formed by extending a yoke 4*c* (see FIG. 2) to the axial direction. The yoke 4*c* forms a magnetic circuit of the electric motor 4.

In the cylindrical casing 11 shown in FIG. 1B according to the first embodiment, the cylindrical body part 11*a* and the ring bottom part 11*b* are assembled together. The present invention is not limited to the above structure. For example, the present invention allows the cylindrical body part 11*a* and the ring bottom part 11*b* to be separated parts.

Each rotatable disk 12 has a ring shape. The outer peripheral part of the rotatable disk 12 has a circular shape. The inner peripheral part of the rotatable disk 12 has a tooth shape, which forms the internal gear 5*b*.

Each rotatable disk 12 has a diameter which is slightly smaller than the inner diameter of the cylindrical casing 11. The rotatable disks 12 are rotatably placed in the cylindrical casing 11 so that the cylindrical casing 11 and the rotatable disks 12 are concentrically placed, namely, stacked together.

A plurality of projecting parts 13*a* is formed at the outer periphery of each fixed disk 13. The fixed disks 13 are placed to form a ring shape. Each projecting part 13*a* of the fixed disk 13 is fitted to the inside of the corresponding convex part 11*c* formed on the cylindrical casing 11. This structure prevents the rotation of the fixed disks 13 toward the circumferential direction of the cylindrical casing 11.

The outer diameter of each fixed disk 13 other than the projecting part 13*a* has approximately the same diameter as the outer diameter of the rotatable disk 12. The inner diameter of each fixed disk 13 is slightly larger than the tooth-bottom diameter of the internal gear 5*b* in order to avoid any interference between the planetary gears 5*c* and the fixed disks 13.

As shown in FIG. 1B, each fixed disk 13 is placed between the adjacent rotatable disks 12 in order to form the disk stack structure composed of the rotatable disks 12 and the fixed disks 13.

As shown in FIG. 1B, the disk spring 14 is placed between the bottom part 11*b* of the cylindrical casing 11 and the fixed disk 13 at one end side of the disk stack structure (at the bottom part 11*b* side of the cylindrical casing 11).

Caulking parts 11*d* (as pushing means) are placed at the opening part side of the cylindrical casing 11 and then bent toward the inner diameter side of the cylindrical casing 11 so that the disk spring 14 is pushed toward the bottom part 11*b* side of the cylindrical casing 11 through the disk stack structure. Thereby, the disk spring 14 accumulates the reaction force therein. The reaction force (or an elastic force) accumulated in the disk spring 14 pushes the disk stack structure toward the axial direction of the cylindrical casing 11.

Figure 4:
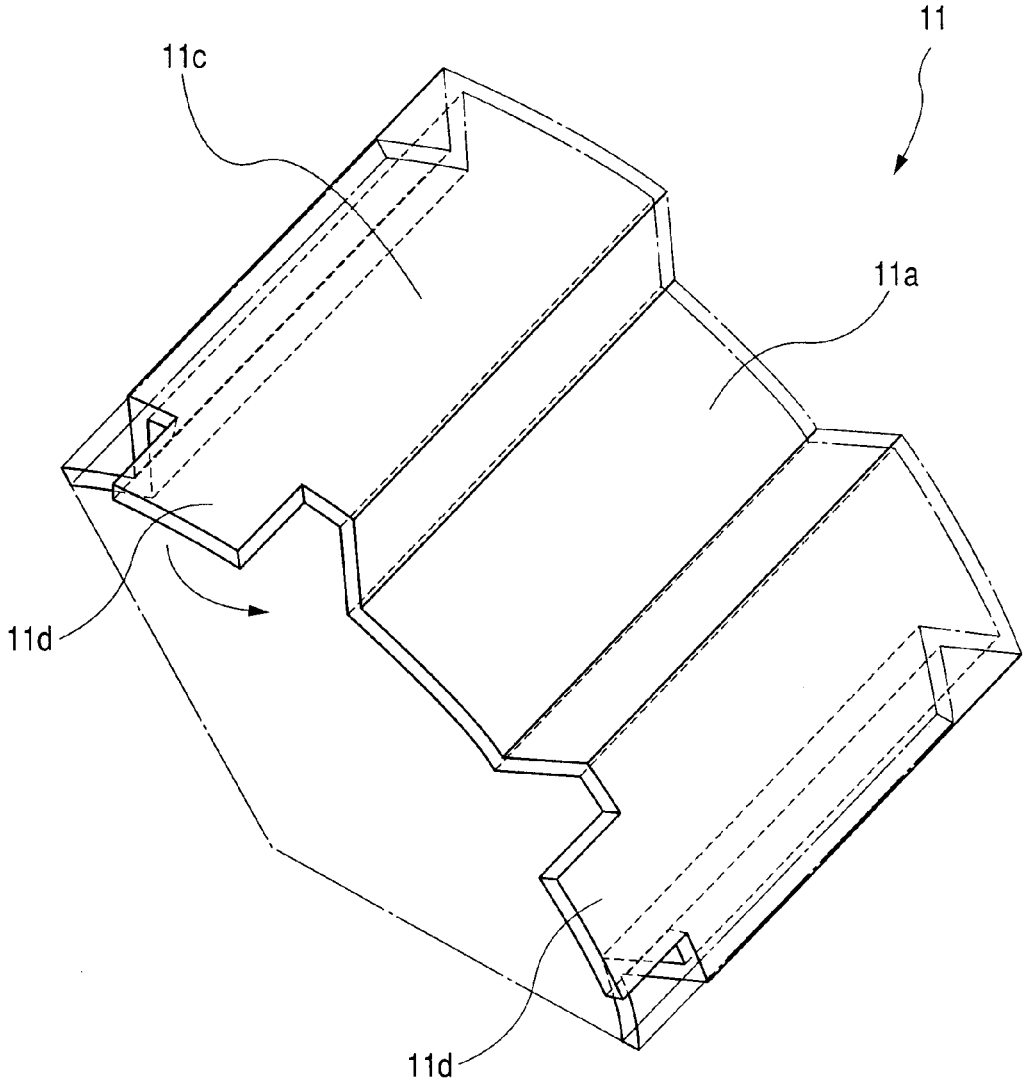
FIG. 4 is a perspective view of the caulking parts that are extended from the convex parts formed at the opening end side of the cylindrical casing in the starter motor according to the first embodiment of the present invention.

FIG. 4 is a perspective view of the caulking parts 11*d* extended from the convex part 11*c* formed at the opening end side of the cylindrical casing 11 in the starter motor 1 according to the first embodiment of the present invention. As shown in FIG. 4, the caulking part 11*d* of the cylindrical casing 11 is extended from the outer peripheral wall of the convex part 11*c* formed in the cylindrical body part 11*a*.

As designated by the arrow shown in FIG. 4, each caulking part 11*d* is bent toward the inside diameter direction of the cylindrical casing 11 so as to contact with the fixed disk 13 at the other end side of the disk stack structure. Still further, the caulking parts 11*d* are bent with the disk spring 14 and the disk stack structure until the reaction force of a predetermined magnitude is accumulated in the disk spring 14, in other words, until a sliding torque of a predetermined magnitude is accumulated between the rotatable disks 12 and the fixed disks.

According to the starter motor equipped with the shock absorbing device having the above structure, when the internal combustion engine starts to operate and an excessive shock over the sliding torque of the rotatable disks 12 is propagated from the internal combustion engine to the starter motor 1, the rotatable disks 12 in the shock absorbing device 10 slide or rotate to interrupt the excessive-shock transmission to the driving system of the starter motor 1. This structure protects the driving system of the starter motor 1 from the excessive shock.

In the shock absorbing device 10 according to the first embodiment, the cylindrical casing 11 has a space to adequately pass through bolts 3 between the convex parts 11*c* formed in the cylindrical body part 11*a*, as shown in FIG. 1A. That is, as shown in FIG. 2, the through bolts 3 are inserted from the rear side of the end frame 16, which accommodates the opening part at the end part of the yoke 4*c*, to the inside of the yoke 4*c*. The through bolts 3 further pass between field magnet poles 4*d* (for example, made of permanent magnets), and reach the housing 2. The through bolts 3 are fastened to the housing 2 through the space formed between the convex parts 11*c* of the cylindrical casing 11 in the shock absorbing device 10.

(Effects of the Structure of the Shock Absorbing Device in the Starter Motor According to the First Embodiment of the Present Invention)

In the structure of the shock absorbing device 10 to be assembled into the starter motor 1, the disk spring 14 is placed at the bottom part 11*b* side of the cylindrical casing 11, namely, between the bottom part 11*b* of the cylindrical casing 11 and one side of the disk stack structure. This structure enables the disk spring 14 to receive a uniform load or pressure from the caulking parts 11*d*.

Further, placing the disk spring 14 between the bottom part 11*b* of the cylindrical casing 11 and the fixed disk at the other side of the disk stack structure prevents the disk spring 14 from being inclined. This improves the assembling efficiency of the disk spring 14, the fixed disks 13, and the rotatable disks 12 into the cylindrical casing 11.

Still further, the above structure of the shock absorbing device 10 is free from directly caulking the sloped surface of the disk spring 14, and enables the caulking work for the surface of the fixed disk 13 placed at the other side of the disk stack structure. The above structure of the shock absorbing device 10 provides easy caulking work when compared with the conventional caulking work.

In the structure of the starter motor 1 equipped with the shock absorbing device 10 according to the first embodiment, the through bolts 3 are placed through the space which is formed between the convex parts 11*c* formed in the cylindrical casing 11. This structure does not require any placement of the entire of the shock absorbing device 10 in the inside (referred to as the "inscribed circle") of the circle that contacts with a plurality of the through bolts. That is, although the convex parts 11*c* are formed in the cylindrical casing 11 of the shock absorbing device 10 in order to stop the rotation of the fixed disks 13, this structure does not require the outer diameter of each convex part 11*c* to be smaller than the diameter of the inscribed circle. That is, because this structure allows that the yoke 4*c* has the same dimension of the inner diameter of the cylindrical wall 15 which is extended toward the axial direction, it is possible that the outer diameter of the arcshaped wall formed between the convex parts 11*c* (see FIG. 4) can be expanded to the dimension equal the diameter of the inscribed circle.

As a result, because the above structure has an adequate frictional area between the rotatable disk 12 and the fixed disk 13 even if the through bolts 3 are inserted into the inside of the yoke 4*c*, it is possible to avoid any deterioration of the anti-abrasion function.

Still further, because the above structure of the shock absorbing device 10 does not greatly reduce the space for placing the disk spring 14 in the cylindrical casing 11, it is possible to maintain the adequate durability of the disk spring 14 without any increasing the stress to the disk spring 14.

The shock absorbing device 10 to be assembled into the starter motor according to the first embodiment has the structure in which the rotatable disks 12 and the fixed disks 13 are alternately stacked in the axial direction of the cylindrical casing 11 in order to push them by the elastic force of the disk spring 14. That is, because the above structure of the shock absorbing device 10 does not place the rotatable disks and the fixed disks 13 in the diameter direction of the cylindrical casing, it is not required to keep a large space in the diameter direction of the cylindrical casing 11. This structure can reduce the entire space of the shock absorbing device 10.

Still further, because the structure of the shock absorbing device 10 can increase the number of the rotatable disks 12 and the fixed disks 13 to be placed in the cylindrical casing 11, it is possible for the shock absorbing device 10 to improve the shock absorbing capability.

Second Embodiment

A description will be given of the shock absorbing device 10-1 to be assembled in the starter motor according to the second embodiment of the present invention with reference to FIG. 5.

Figure 5:
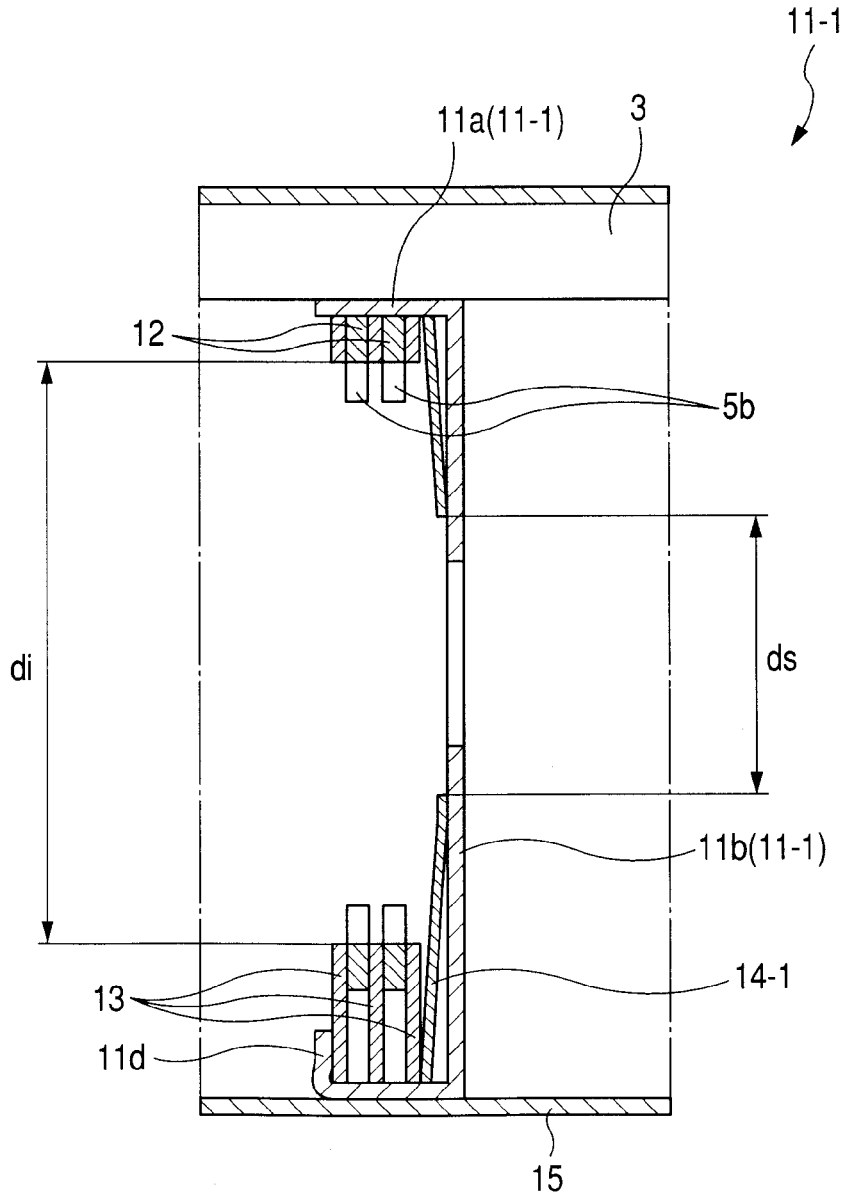
FIG. 5 is a cross section of the shock absorbing device along its axial direction in the starter motor according to the second embodiment of the present invention.

FIG. 5 is a cross section of the shock absorbing device 10-1 along its axial direction in the starter motor 1 according to the second embodiment of the present invention.

In the shock absorbing device 10-1 in the starter motor 1 according to the second embodiment shown in FIG. 5, the inner diameter "ds" of the disk spring 14-1 is smaller than the diameter "di" of the tooth bottom of the internal gear 5*b* formed in the rotatable disks 12. Placing the disk spring 14-1 on the bottom part 11*b* of the cylindrical casing 11-1 (namely, at the position between the bottom part 11*b* of the cylindrical casing 11-1 and the fixed disk 13 placed at the other end side of the disk stack structure) can avoid any interference between the disk spring 14-1 and the planetary gears 5*c* that are engaged with the internal gear 5*b* even if the inner diameter "ds" of the disk spring 14-1 is formed to be smaller than the diameter "di" of the tooth bottom of the internal gear 5*b*.

This structure of the shock absorbing device 10-1 has a large ratio of, the inner diameter and the outer diameter of the disk spring 14-1 when compared with that of the cylindrical casing where the disk spring is placed at the opening side of the cylindrical casing 11. That is, the structure of the shock absorbing device 10-1 having the disk spring 14-1 of a large width of its slope surface can reduce the stress which is repeatedly applied to the disk spring 14-1. As a result, because the duration of the disk spring 14-1 can rise, the lifetime of the starter motor 1 becomes long as well as the disk spring 14-1, and shock absorbing device 10-1.

Third Embodiment

A description will be given of the shock absorbing device 10-2 to be assembled in the starter motor according to the third embodiment of the present invention with reference to FIG. 6.

Figure 6:
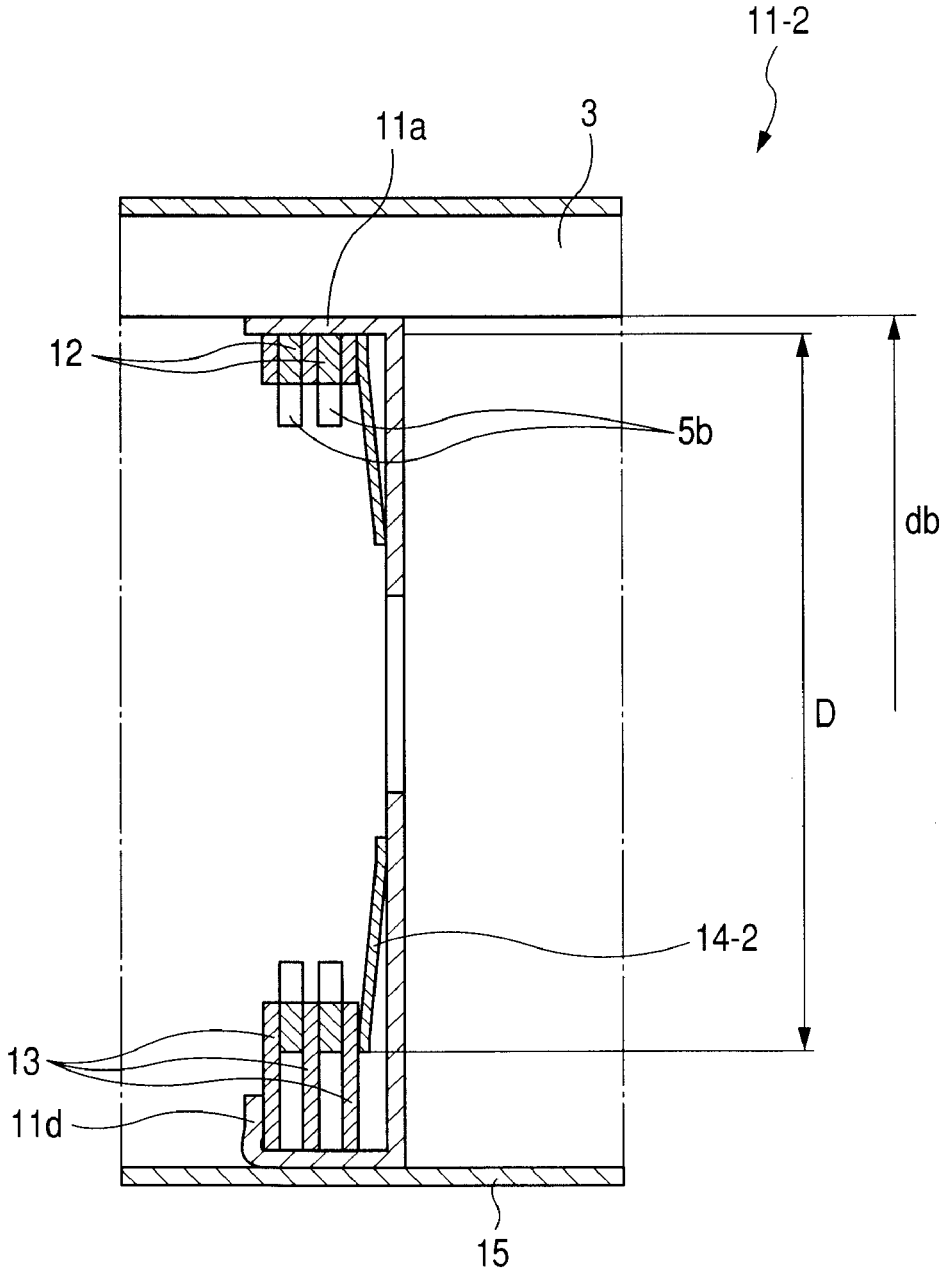
FIG. 6 is a cross section of the shock absorbing device along its axial direction in the starter motor according to the third embodiment of the present invention.
Figure 7:
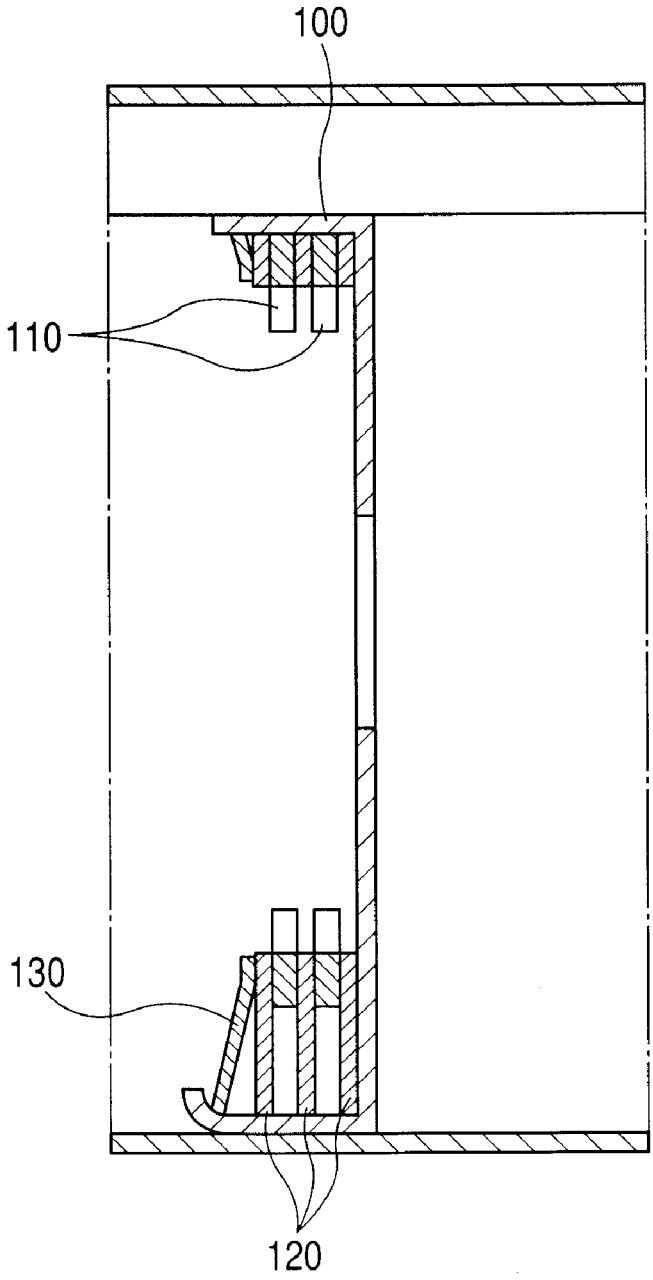
FIG. 7 PRIOR ART
FIG. 7 is a cross section of a conventional shock absorbing device of a multiple-disk type assembled into a conventional starter motor.

FIG. 6 is a cross section of the shock absorbing device 10-2 along its axial direction in the starter motor according to the third embodiment of the present invention.

As shown in FIG. 6, the diameter D of the disk spring 14-2 in the shock absorbing device 10-2 is smaller than the inner diameter "db" of the inscribed circle of the through bolts 3. This structure of the cylindrical casing 11-2 avoids having a convex and concave shape in order to place the through bolts 3 in the cylindrical casing 11-2. That is, this structure of the cylindrical casing 11-2 allows the disk spring 14-2 to have a simple shape. Because this structure of the cylindrical casing 11-2 allows the profile of the disk spring 14-2 to have a simple shape, it is possible to use a disk spring corresponding to standard such as JIS (Japanese Industrial Standard).

(Modification)

The first embodiment shows the method of caulking the caulking part 11*d* formed at the opening side of the cylindrical casing 11 toward the inner diameter direction of the cylindrical casing 11. The present invention is not limited to the structures described before. For example, it is possible to press-fit a C ring (or character "C" shape ring) as a press member into the inner periphery of the cylindrical casing 11.

(Other Features of the Present Invention)

In the starter motor as another aspect of the present invention, the inner diameter of the disk spring is smaller than the diameter of a tooth bottom of the internal gear formed in the rotatable disks. Because the disk spring is placed between the bottom part of the cylindrical casing and the disk stack structure, this causes no interference between the disk spring and the planetary gear that is mated with the internal gear even if the inner diameter of the disk spring is made to be smaller than the diameter of the tooth bottom of the internal gear. This structure makes it possible to increase the ratio of the outer diameter and the inner diameter of the disk spring (namely, to form a large width of the sloped surface of the disk spring) rather than the conventional cylindrical casing in which the disk spring is placed at the opening end side of the cylindrical casing. That is, this structure of the shock absorbing device decreases the magnitude of force applied to the disk spring in the cylindrical casing. As a result, this structure has a long lifetime of the disk spring with a reduced space in the cylindrical casing, and provides the shock absorbing device with a high performance.

In the starter motor as another aspect of the present invention, the pushing means is composed of a plurality of caulking parts formed at an opening side of the cylindrical casing in which the caulking parts are bent toward the inner diameter side of the cylindrical casing in order to generate the pushing force applied to the disk spring toward the direction of the bottom part of the cylindrical casing.

The pushing means is made by caulking the caulking member formed at the opening end part of the cylindrical casing toward the inner diameter of the cylindrical casing. The pushing member thereby pushes the disk spring toward the bottom part of the cylindrical casing through the disk stack structure. That is, the present invention does not require the sloped surface of the disk spring to be directly caulked, only performs the caulking to the surface of the fixed disks. This structure improves the assembling efficiency for the shock absorbing device when compared with the conventional cylindrical casing to directly caulk the sloped surface of the disk spring.

In the starter motor as another aspect of the present invention, the pushing means is a pressing member that is pressedly inserted and fitted, by a predetermined depth measured from the opening part of the cylindrical casing, into the inner periphery of the opening side of the cylindrical casing in order to press the disk spring toward the direction of the bottom part of the cylindrical casing through the disk stack structure.

The structure of the shock absorbing device according to the present invention does not require to directly push the sloped surface of the disk spring using the pressing means, but requires only to insert the disk spring to the surface of the fixed disks. This can improve the assembling efficiency of the disk spring when compared with the conventional case to directly caulk the sloped surface of the disk spring.

In the starter motor as another aspect of the present invention, the cylindrical casing has a plurality of convex parts that project from the circumferential part of the cylindrical casing toward the outside of the cylindrical casing in the diameter direction of the cylindrical casing. A plurality of the projecting parts is formed at the outer periphery of the fixed disks. The projecting parts are engaged with the inside of the convex parts of the cylindrical casing in order to limit the rotation of the fixed disks in the circumferential direction. The starter motor is fixed to a housing by a plurality of through bolts, the through bolts pass through the inside of a yoke forming an magnetic circuit of the electric motor, and further pass through the space formed between the convex parts of the cylindrical casing, and finally reach the housing. The outer periphery of the disk spring has a circular shape, and the diameter of the outer periphery of the disk spring is smaller than a circle that is inscribed in an inscribed circle of the through bolts.

The through bolts can be inserted in the starter motor through the space formed between the adjacent convex parts in the circumferential direction of the cylindrical casing. This can avoid placing the shock absorbing device only in the inside of the inscribed circle of the through bolts. This structure of the shock absorbing device avoids largely decreasing the friction area between the rotatable disks and the fixed disks, and also avoids any decreasing the friction capability between the rotatable disks and the fixed disks.

Still further, the above structure of the shock absorbing device does not require forming any convex and concave structure in the disk spring in order to pass the through bolts, and makes thereby it possible to form the disk spring with a simple shape. That is, because the structure of the shock absorbing device according to the present invention can use the disk spring of a simple circular-outline, it is possible to use a disk spring corresponding to various types of standards such as JIS (Japanese Industrial Standard).

In the starter motor as another aspect of the present invention, the electric motor is a field magnet motor using permanent magnets as field magnetic poles placed at the inner periphery of the yoke. The through bolts are placed to pass between the circumferential-adjacent permanent magnets toward the axial direction of the starter motor.

Using the permanent magnets as the field magnetic poles of the electric motor can easily make a gap which allows the through bolts pass between the adjacent permanent magnets without any contacting.

While specific embodiments of the present invention have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present invention which is to be given the full breadth of the following claims and all equivalent thereof.

What is claimed is:

1. A starter motor comprising:

an electric motor generating a rotational power;

a planetary gear speed reduction device that reduces a rotation speed of the electric motor and outputs the reduced rotation speed;

a shock absorbing device that limits a rotation of an internal gear in the planetary gear speed reduction device by a friction force, and absorbs a shock applied from an internal combustion engine by rotating the internal gear against the friction when the internal gear receives the shock caused by a load torque over a predetermined level, the shock absorbing device comprising:

a cylindrical casing comprising an annular bottom flange, a cylindrical wall part, and an upper part, the annular bottom flange being opposite to the upper part and the cylindrical wall part extending between the annular bottom flange and the upper part, the upper part being formed by bending a distal end of the cylindrical wall part toward an inside of the cylindrical casing;

a plurality of rotatable disks placed in an inner periphery of the cylindrical casing, each of the plurality of rotatable disks having a radial inner surface having a first diameter, wherein the internal gear is formed on said radial inner surface;

a plurality of fixed disks fixedly placed in an inner periphery of the cylindrical casing so that each rotatable disk is sandwiched between a pair of adjacent fixed disks;

a frustoconical disk spring comprising:

a first end having an inner diameter, wherein said inner diameter is smaller than said first diameter; and a second end, opposite the first end, the second end having an outer diameter larger than the inner diameter and larger than the first diameter;

wherein the first end of the disk spring abuts the annular bottom flange of the cylindrical casing and the second end of the disk spring abuts a disk stack structure composed of the rotatable disks and the fixed disks stacked alternately; and wherein the upper part of the cylindrical casing is caulked toward the annular bottom flange to fix the disk stack structure against the second end of the disk spring, and the disk spring generates an elastic force against the disk stack structure; and wherein the inner diameter and outer diameter of the disk spring are selected so as to provide a spring constant that provides a stable spring load to the disk stack structure in the cylindrical case.

2. The starter motor according to claim 1, wherein the upper part is composed of a plurality of caulking parts formed at an opening side of the cylindrical casing in which the caulking parts are bent toward an inner diameter side of the cylindrical casing in order to generate a pushing force applied to the disk spring toward the bottom flange of the cylindrical casing.

3. The starter motor according to claim 1, wherein the upper part is a pressing member that is inserted and fitted, by a predetermined depth measured from an opening part of the cylindrical casing, into the inner periphery of the cylindrical casing in order to press the disk spring toward the bottom flange of the cylindrical casing through the disk stack structure.

4. The starter motor according to claim 1, wherein the cylindrical casing has a plurality of convex parts that projects from a circumferential part of the cylindrical casing toward the outside of the cylindrical casing in a radially outward direction from the cylindrical casing, and a plurality of projecting parts are formed at an outer periphery of the fixed disks, and the projecting parts are engaged with the inside of the convex parts of the cylindrical casing in order to limit the rotation of the fixed disks in a circumferential direction, and the starter motor is fixed to a housing by a plurality of through bolts, the through bolts pass through the inside of a yoke forming a magnetic circuit of the electric motor, and further pass through a space formed between the convex parts of the cylindrical casing, and reach the housing, and the outer periphery of the disk spring has a circular shape, and the outer diameter of the the disk spring is smaller than a circle that is formed by the through bolts.

5. The starter motor according to claim 1, wherein the electric motor is a field magnet motor using permanent magnets as field magnetic poles placed at the inner periphery of the yoke, and a plurality of through bolts are placed to pass between the permanent magnets toward an axial direction of the starter motor.

* * * * *